US006489836B2

(12) United States Patent
Yeong

(10) Patent No.: US 6,489,836 B2
(45) Date of Patent: Dec. 3, 2002

(54) LEVEL-SHIFTING REFERENCE VOLTAGE SOURCE CIRCUITS AND METHODS

(75) Inventor: Jeon Baek Yeong, Kyungki-do (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 09/742,676

(22) Filed: Dec. 20, 2000

(65) Prior Publication Data

US 2001/0005161 A1 Jun. 28, 2001

(30) Foreign Application Priority Data

Dec. 21, 1999 (KR) ..... 99-59822

(51) Int. Cl.[7] ..... G05F 11/10
(52) U.S. Cl. ..... 327/541; 327/540
(58) Field of Search ..... 327/538, 540, 327/541, 543; 323/313, 315

(56) References Cited

U.S. PATENT DOCUMENTS 5,521,489 A * 5/1996 Fukami ..... 323/313
5,532,578 A * 7/1996 Lee ..... 327/538
5,777,509 A * 7/1998 Gasparik ..... 327/543
6,040,735 A * 3/2000 Park et al. ..... 327/541
6,166,589 A * 12/2000 Park ..... 327/540

OTHER PUBLICATIONS

Yoo et al., "Variable Vcc Design Techniques for Battery Operation DRAMs," 1992 Symposium on VLSI Circuits Digest of Technical Papers, pp. 110–111.

* cited by examiner

*Primary Examiner*—Terry D. Cunningham
(74) *Attorney, Agent, or Firm*—Myers Bigel Sibley & Sajovec

(57) ABSTRACT

A reference voltage source circuit includes a reference voltage generation circuit that inputs external power voltage and produces a first reference voltage with a first temperature characteristic, and a level shifter circuit that produces a second reference voltage with the first temperature characteristic from the first reference voltage and outputs the second reference voltage as a reference voltage. For example, the reference voltage generation circuit may use a circuit configuration that is configurable to produce reference voltage in first and second ranges with respective positive and negative temperature characteristics, and the reference voltage generation circuit is configured to produce the first reference voltage in the first range with a positive temperature characteristic. The level shifter circuit may be operative to provide a voltage drop between the first and second reference voltages such that the second reference voltage is in the second range. Related methods are also discussed.

4 Claims, 2 Drawing Sheets

LEVEL-SHIFTING REFERENCE VOLTAGE SOURCE CIRCUITS AND METHODS

RELATED APPLICATION

This application is related to Korean Application No. 99-59822, filed Dec. 21, 1999, the disclosure of which is hereby incorporated herein by reference.

FIELD OF THE INVENTION

The present invention relates to electronic generation circuits and methods, and more particularly, to reference voltage source circuits and methods.

BACKGROUND OF THE INVENTION

It is generally desirable to maintain stable internal power supply voltage levels in integrated circuits (ICs) in order to prevent damage and maintain desired operational characteristics.

Accordingly, integrated circuits often include power supply voltage regulation circuits that generate internal power supply voltages from externally supplied power supply voltages.

These internal power supply voltage regulation circuits often use reference voltages produced by reference voltage generation circuits. Such reference voltage generation circuits may take many forms.

One type of reference voltage generation circuit includes a MOS transistor that has its drain and gate terminals tied together, and which has an associated threshold voltage that is used to generate a reference voltage. However, the threshold voltage of such a MOS transistor typically varies responsive to temperature and process variations. Accordingly, the accuracy of such reference voltage generation circuits may be sensitive to variations in temperature and process.

A conventional reference voltage generation circuit may use complementary circuits having respective positive and negative temperature coefficients to reduce sensitivity to temperature changes. Such circuits are described, for example, in "VARIABLE VCC DESIGN TECHNIQUES FOR BATTERY OPERATED DRAMS," Symposium on VLSI Circuit Digest of Technical Papers, pp. 110–111, 1992.

Referring to FIG. 1, a conventional temperature compensating reference voltage generation circuit includes a power supply voltage terminal that receives a power supply voltage Vcc, a ground voltage terminal that is connected to a power supply ground Vss, and an output terminal at which a reference voltage VREF is produced. In further detail, the reference voltage generation circuit includes a current limiting resistor R1 coupled between the power supply voltage Vcc and a node N1. The reference voltage generation circuit further includes a voltage divider circuit including a second resistor R2 connected to the node N1, and first and second NMOS transistors M1, M2 that are serially connected between a node N2 and the power supply ground Vss, and have their gate terminals coupled to the node N1 and the power supply voltage Vcc, respectively. A P-MOS transistor M3 is coupled between the output terminal and the power supply ground Vss, and has its gate terminal coupled to the node N2.

If the "on" resistance of the first and second NMOS transistors M1, M2 is denoted $R_{eq}$, and a threshold voltage of the PMOS transistor M3 is denoted $|V_{tp}|$, the reference voltage VREF may be expressed as:

In equation (1), the temperature coefficient of the PMOS transistor threshold $$VREF = \left(\frac{1 + Req}{R2}\right) cVtpc \tag{1}$$

voltage $|V_{tp}|$ typically is negative, while the temperature coefficient of the on resistance Req of the first and second NMOS transistors M1, M2 is typically positive. Accordingly, the reference voltage VREF is generated regardless of the temperature variation. That is, the reference voltage VREF regardless of the temperature variation can be obtained by offsetting the temperature variation by |Vtp| having the negative temperature coefficient and Req having the positive temperature coefficient.

However, the temperature characteristics of PMOS transistor M3 and NMOS transistors M1, M2 are opposite each other and also typically non-linear. For example, above a critical voltage Vcr(e.g., 1.2V), the reference voltage VREF produced by the conventional reference voltage generating circuit of FIG. 1 may increase with increasing temperature.

However, below the critical voltage Vcr, the reference voltage VREF may decrease with increasing temperature, such that the reference voltage VREF(Hot) at a relatively high temperature is less than the reference voltage VREF (Cold) at a relatively low temperature, as shown in FIG. 2.

Such a negative temperature characteristic may be undesirable when producing a reference voltage for a power supply circuit. As the reference voltage decreases with increasing temperature, the level of the power supply voltage that is generated based on the reference voltage may also decrease. This can cause operating speeds of circuits receiving the power supply voltage to decrease.

This phenomenon can represent an obstacle to effectively using low power supply voltages, such as 3.3V.

SUMMARY OF INVENTION

According to embodiments of the present invention, a reference voltage source circuit includes a reference voltage generation circuit that inputs external power voltage and produces a first reference voltage with a first temperature characteristic, and a level shifter circuit that produces a second reference voltage with the first temperature characteristic from the first reference voltage and outputs the second reference voltage as a reference voltage. In particular, the reference voltage generation circuit may use a circuit configuration that is configurable to produce reference voltages in first and second ranges with respective positive and negative temperature characteristics, with the reference voltage generation circuit being configured to produce the first reference voltage in the first range with a positive temperature characteristic. The level shifter circuit may be operative to provide a voltage drop between the first and second reference voltages such that the second reference voltage is in the second range.

In embodiments of the present invention, the reference voltage generation circuit includes a first resistor having a first terminal connected to a power supply node and a second terminal connected to a first node at which the first reference voltage is produced, and a second resistor having a first terminal coupled to the first node. A first NMOS transistor has a source terminal connected to a drain terminal of the first NMOS transistor at a third node, a gate terminal connected to the power supply node, and a drain terminal connected to a power supply ground. A PMOS transistor has a source terminal connected to the first node, a gate terminal connected to the second node and a drain terminal connected to the power supply ground. In other embodiments of the invention of the present invention, the level shifter circuit includes an NMOS transistor having a source terminal and a gate terminal coupled to the first node and a drain terminal connected to a fourth node at which the second reference voltage is produced.

In still other embodiments of the present invention, the reference voltage generation circuit includes a current limit circuit coupled to a power supply node, a voltage divider circuit coupled to the current limit circuit at a first node at which the first reference voltage is produced and to a power supply ground and a voltage source circuit coupled to the voltage divider circuit at the first node and at a second node. The level shifter circuit includes a voltage drop circuit coupled between the first node and a third node at which the second reference voltage is produced, and a current pass circuit coupled between the third node and the power supply ground.

In method embodiments of the present invention, a first reference voltage with a first temperature characteristic is generated. The first reference voltage is level shifted to produce a second reference voltage with the first temperature characteristic For example, a reference voltage generation circuit may be configured to produce the first reference voltage in a first range with a positive temperature characteristic, wherein the reference voltage generation circuit uses a circuit configuration that is configurable to produce reference voltages in the first range and a second range with respective positive and negative temperature characteristics. A voltage drop may be provided between the first and second reference voltages such that the second reference voltage is in the second range.

BRIEF DESCRIPTION OF THE ATTACHED DRAWINGS

DETAILED DESCRIPTION OF THE INVENTION

Figure 1:
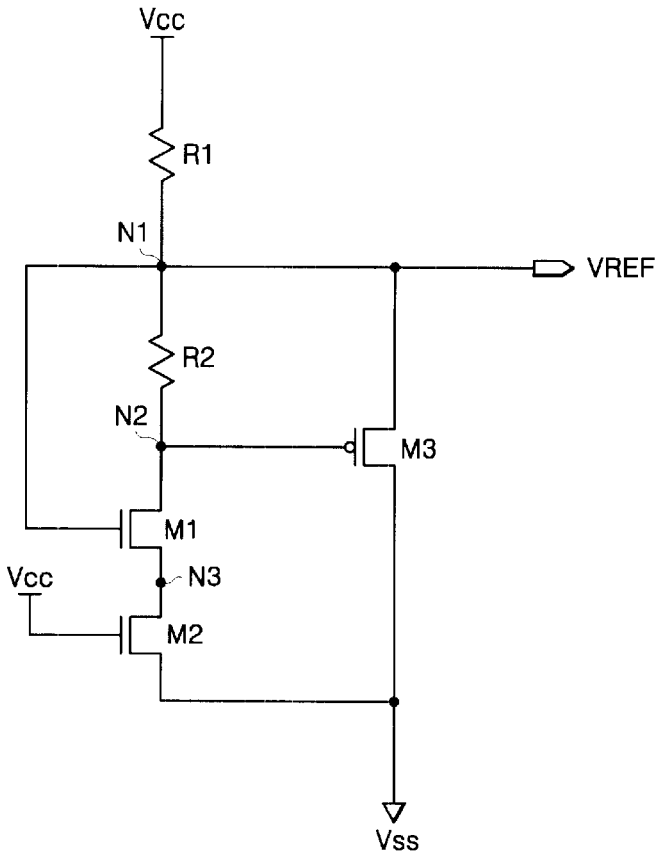
FIG. 1 PRIOR ART
FIG. 1 is a schematic diagram illustrating a conventional reference voltage generation circuit.
Figure 2:
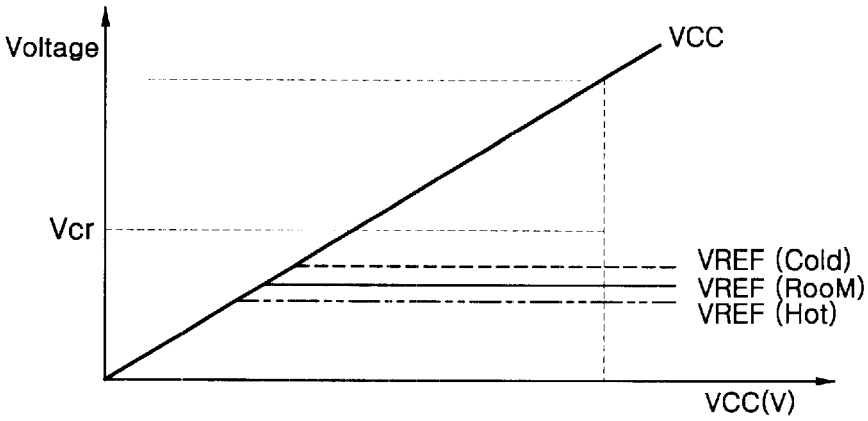
FIG. 2 PRIOR ART
FIG. 2 is a graph illustration a temperature characteristic of the reference voltage generation circuit of FIG. 1.
Figure 3:
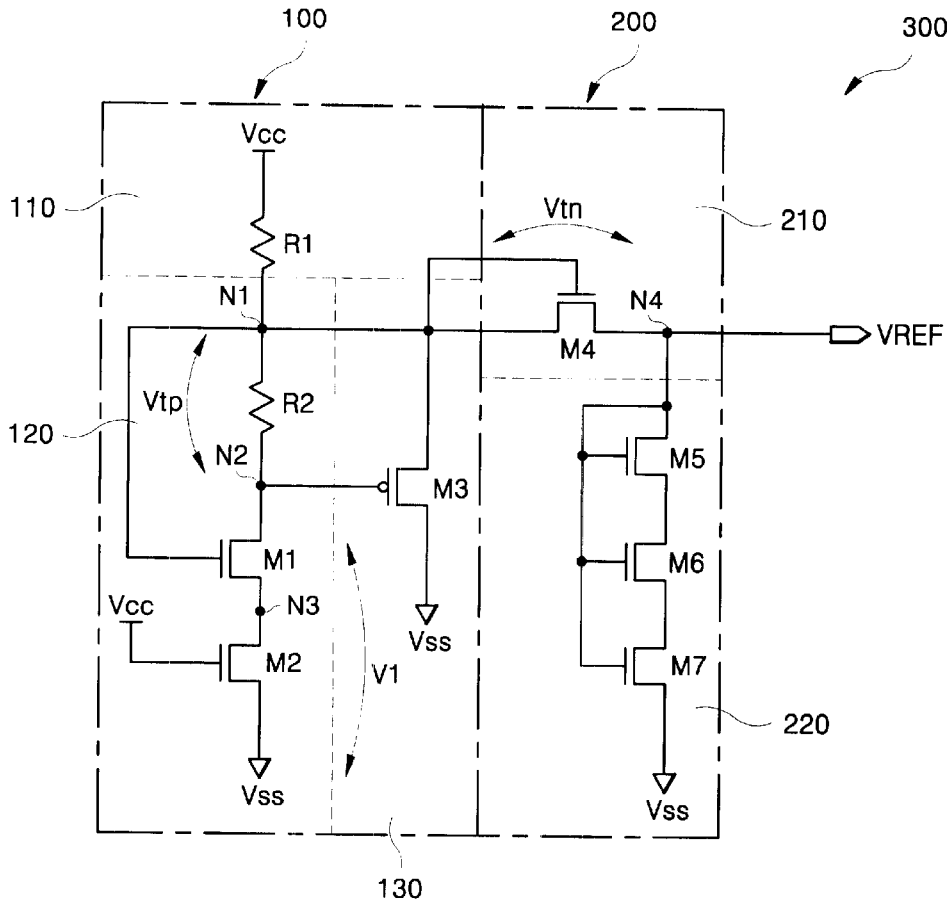
FIG. 3 is a schematic diagram illustrating a reference voltage generation circuit according to embodiments of the present invention.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. FIG. 3 illustrates a reference voltage source circuit 300 according to embodiments of the present invention. The reference voltage source circuit 300 includes a reference voltage generation circuit 100 and a level shifter circuit 200.

The reference voltage generation circuit 100 includes a current limiting circuit 110 including a first resistor R1 connected to a power supply node Vcc, and a voltage divider circuit 120 including a second resistor R2 that is connected to the first resistor R1 at a node N1.

The voltage divider circuit 120 further includes first and second NMOS transistors M1, M2, in series coupled between a node N2 and a power supply Vss and having their gate terminals coupled the node N1 and the power supply voltage Vcc, respectively.

The reference voltage generation circuit 100 further includes a voltage source circuit 130 including a PMOS transistor M3 coupled between the node N1 and the power supply ground Vss and having a gate connected to the node N2.

The level shifter circuit 200 includes a voltage drop circuit 210 includes an NMOS transistor M4 having its source and gate terminals tied together at the node N1, and its drain terminal tied to an output node N4 at which a reference voltage VREF is produced. Connected in this manner, the NMOS transistor M4 acts like a forward biased diode, providing a voltage drop between the nodes N1, N4.

The current pass circuit 220 includes three NMOS transistors M5, M6, M7 that are coupled in series between the output node N4 and the power supply ground Vss. The gates of each of the NMOS transistors M5, M6, M7 are connected to the output node N4.

In the reference voltage generation circuit 100, the resistor R1 generally serves to limit current drawn from the power supply node Vcc in generating a preliminary reference voltage VPREF. The resistor R2 determines the level of the preliminary reference voltage VPREF. The PMOS transistor M3 maintains a threshold voltage Vtp across the resistance R2. The channel resistance of the first NMOS transistor M1 varies responsive to the preliminary reference voltage VPREF. the second NMOS transistor M2 is turned on responsive to the voltage at the power supply node Vcc. That is, when the power supply voltage Vcc is applied to the gate of the second NMOS transistor M2, the circuit 300 is enabled.

The preliminary reference voltage VPREF may be expressed as:

$$V_{PREF}=V_{tp}+V1(=I_dR_{eq}) \tag{2}$$

where the threshold voltage of the PMOS transistor M3 is Vtps, and the sum of the channel resistance of the first NMOS transistor M1 and the channel resistance of the second NMOS transistor M2 is Req, and the voltage and the current across the first and second NMOS transistors M1, M2 are V1 and $I_d$, respectively.

Also, the preliminary reference voltage VPREF of the equation (2) may be expressed as:

$$VPREF=(Vtp(T0)+\Delta Vtp(T))+(V1(T0)+\Delta V1(T)) \tag{3}$$

where Vtp(T0) is the threshold voltage of the PMOS transistor M3 at a reference temperature T0(e.g., room temperature), ΔVtp(T) is an amount of change in the threshold voltage of the PMOS transistor M3 with temperature T, V1(T0) is a turn-on voltage of NMOS transistors M1, M2 at the reference temperature T0, and ΔV1(T) is an amount of change in the turn-on voltage of the NMOS transistors M1, M2 with temperature T.

In the equation (3), ΔVtp(T) is decreased and ΔV1(T) is increased according to the increase of temperature.

Therefore, if the preliminarily reference voltage VPREF is below a critical voltage (e.g. 1.2V), VPREF become lower than VPREF of a low temperature since ΔV1(T) become smaller than ΔVtp(T) according to the increase of temperature. On the other hand, if the preliminarily reference voltage VPREF is above a critical voltage (e.g. 1.2V), VPREF become higher than VPREF of a low temperature since ΔV1(T) become larger than ΔVtp(T) according to the increase of temperature.

Figure 4:
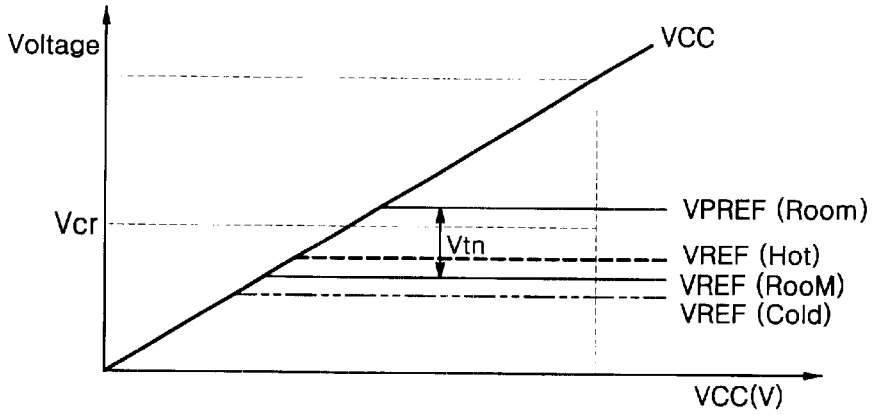
FIG. 4 is a graph illustrating exemplary temperature characteristics for the circuit of FIG. 3.

Accordingly, in embodiments of the present invention, the resistor R2 is selected such that the preliminary reference voltage VPREF is above a critical voltage Vcr (e.g., 1.2V) at which the circuit configuration used in the reference voltage generation circuit 100 changes from producing the preliminary reference voltage VPREF with a positive temperature characteristic, i.e., such that the preliminary reference voltage VPREF increases with increasing temperature. As illustrated in FIG. 4, a preliminary reference voltage VPREF produced with a positive temperature characteristic may be level shifted by the level shifter circuit 200 to produce a reference voltage VREF at the output node N4 according to the relation:

$$VREF=VPREF-Vtn \quad (4)$$

Where Vtn is a threshold voltage of the NMOS transistor M4. As shown in FIG. 4, the reference voltage VREF may be is less than the critical voltage Vcr, while maintaining a positive temperature characteristic. In particular, the reference voltage VREF(Hot) is greater than the reference voltage VREF(Room) at room temperature, and the reference voltage VREF(Cold) at a low temperature is less than the reference voltage VREF(Room) at room temperature.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A reference voltage source circuit, comprising:

a reference voltage generation circuit that produces a first reference voltage with a first temperature characteristic; and a level shifter circuit coupled to the reference voltage generation circuit and that produces a second reference voltage from the first reference voltage such that the second reference voltage has a temperature characteristic which has the same sign as the first temperature characteristic, wherein the reference voltage generation circuit comprises:

a first resistor having a first terminal connected to a power supply node and a second terminal connected to a first node at which the first reference voltage is produced;

a second resistor having a first terminal coupled to the first node;

a first NMOS transistor having a source terminal connected to a second terminal of the second resistor at a second node and a gate terminal connected to the first node;

a second NMOS transistor having a source terminal connected to a drain terminal of the first NMOS transistor at a third node, a gate terminal connected to the power supply node, and a drain terminal connected to a power supply ground; and a PMOS transistor having a source terminal connected to the first node, a gate terminal connected to the second node and a drain terminal connected to the power supply ground.

2. A reference voltage source circuit according to claim 1:

wherein the level shifter circuit comprises an NMOS transistor having a source terminal and a gate terminal coupled to the first node and a drain terminal connected to a fourth node at which the second reference voltage is produced.

3. A reference voltage source circuit according to claim 2, wherein the level shifter circuit further comprises a current pass circuit coupled between the fourth node and a power supply ground.

4. A reference voltage source circuit according to claim 3, wherein the current pass circuit comprises a plurality of NMOS transistors having channels connected in series between the fourth node and the power supply ground and gate terminals connected to the fourth node.

* * * * *